US006811417B2

(12) United States Patent
Itoh et al.

(10) Patent No.: US 6,811,417 B2
(45) Date of Patent: Nov. 2, 2004

(54) CONNECTOR STRUCTURE

(75) Inventors: Nozomi Itoh, Tokyo (JP); Takuma Inomata, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 10/782,391

(22) Filed: Feb. 18, 2004

(65) Prior Publication Data

US 2004/0175987 A1 Sep. 9, 2004

(30) Foreign Application Priority Data

Feb. 18, 2003 (JP) ..... 2003-039588
Mar. 19, 2003 (JP) ..... 2003-076225

(51) Int. Cl.[7] ..... H01R 13/62
(52) U.S. Cl. ..... 439/157
(58) Field of Search ..... 439/157, 372, 439/364, 559, 557

(56) References Cited

U.S. PATENT DOCUMENTS 5,871,363 A * 2/1999 Kimura ..... 439/157
6,302,720 B1 * 10/2001 Muller ..... 439/347
6,354,852 B2 * 3/2002 Noro et al. ..... 439/157
6,413,105 B2 * 7/2002 Noro et al. ..... 439/157
6,464,681 B1 * 10/2002 Heuser ..... 604/508
6,540,532 B1 * 4/2003 Martin et al. ..... 439/157
6,644,991 B2 * 11/2003 Martin ..... 439/157
6,685,496 B2 * 2/2004 Ookura ..... 439/372
6,767,231 B1 * 7/2004 Martin et al. ..... 439/157

FOREIGN PATENT DOCUMENTS

JP 2002-002414 1/2002

* cited by examiner

*Primary Examiner*—Ross Gushi
*Assistant Examiner*—Phuongchi Nguyen
(74) *Attorney, Agent, or Firm*—J.C. Patents

(57) ABSTRACT

A connector structure comprises a first connector member (20) connected with a first harness (W1) disposed in a first space (R1) defined by a panel (P), a second connector member (10) connected with a second harness (W2) disposed in a second space (R2), a lever member (30) having a shaft portion (30) inserted through a lever inserting hole **(25*a*) of the first connector member (20) in a lever inserting opening (10*a*) of the second connector member (10), from the first space, and a mechanism is provided between the shaft portion (32) and the lever inserting hole (10*a*) of the second connector member (20), for engaging the first and second connectors (20,10) in response to the rotation of the lever member (30)**.

6 Claims, 16 Drawing Sheets

CONNECTOR STRUCTURE

BACKGROUND OF THE INVENTION

1. Field of the Invention

The present invention relates to a connector structure for conducting electrically harnesses provided in front and back spaces of a panel, particularly, to a connector structure suitable for a dash panel of a vehicle.

2. Description of the Prior Art

Conventionally, there is known a connector 50 for a vehicle as shown in FIG. 15 as the connector of the kind as described, for example, as disclosed in Japanese Patent Laid-Open Publication No. 2002-2414 (see pages 4 to 5 on the specification, and FIGS. 5 to 8).

The connector 50 for the vehicle is provided on a dash panel 1 for the vehicle, for defining an engine room A1 and an occupant room A2 and includes a connector member 60 fixed in an opening 1*a* of the dash panel 1 and disposed within the occupant room A2, and a connector member 70 disposed within the engine room A1 for being fitted to the connector member 60 from the engine room A1.

The connector member 60 in the occupant room A2 includes a housing 61 which is disposed in the occupant room A2 and which has a food 61*a* facing the engine room A1 and cavities 62 provided in a portion of the housing 61 within the occupant room A2. The food 61*a* is provided to fit a portion of the connector member 60, disposed in the engine room A1 and includes cam follower portions 61*b* projected inwardly of the food on opposite sides in an inner surface of the food.

Housed in the cavities 62 are terminals in the occupant room, which are connected electrically with a electric box 64. The electric box is provided with terminals 65 disposed in the occupant room A2. Harnesses 63 disposed in the occupant room A2 are connected with the terminals 65 in the occupant room.

On the other hand, the connector member 70 disposed in the engine room A1 includes an introducing portion 71 through which a harness 74 disposed in the engine room A1 is passed, a casing 72 provided at a leading end of the introducing portion 71, and a lever 73 attached rotatable on a supporting shaft 72*a*. provided at an outer side surface of the casing 72. Housed in the casing 72 are terminals disposed in the engine room, which are nut shown and are connected with the harness 74 disposed in the engine room.

The lever 73 is provided with involution-shaped cam grooves 73*a* which have base circles centering on the supporting shaft 72*a*. The cam grooves have at a side of the occupant room A2 thereof openings 73*b* for receiving the cam follower portions 61*b*.

In the connector 50 for the vehicle, having the structure as described above, the casing 72 is inserted in the food 61*a* and then the connector member in the engine room is disposed adjacent the connector member 60 in the occupant room until the cam follower portions 61*b* are inserted through the openings 73*b* in the cam grooves 73*a*.

Subsequently, as shown in FIG. 16, the connector 70 is fitted in the connector member 60 by rotating upwardly the lever 73 about the supporting shaft 72*a*. to conduct electrically the terminals in the engine and occupant rooms, thus conducting electrically the harnesses 74 and 63 in the engine and occupant rooms.

However, because the lever 73 is rotated upwardly about the supporting shaft 72*a*. in the conventional connector 50 for vehicle, an orbit that the lever passes, becomes large when the connector member 70 is fitted in the connector member 60.

Therefore, there is a problem that a large space must be kept in the engine room A1 to fit the connector member 70 in the connector member 60.

In particular, when the connector member 70 cannot be fitted in the connector member 60 unless a large pressed force is operated, there is a problem in the conventional connector 50 that a further large space must be kept in engine room A1, because the lever 73 is required to set in a large size.

In the connector 50, because the plurality of harnesses 63 in the occupant room must be connected with the terminals 65 disposed in the occupant room A2, from the occupant room, it is necessary to provide spaces for the installation of the terminals 65 and for the connection of the terminals and harnesses in the vicinity of the dash panel 1.

In other words, the connector 50 has a configuration that all of harnesses within the occupant room, such as a harness for acceleration, a door harness and so on which are not required to connect in the vicinity of the dash panel 1 are connected with the terminals 65 within the occupant room. Therefore, there is a problem that a space capable of using effectively within the occupant room is reduced in the vicinity of the dash panel 1.

Moreover, because the harness 63 which is within the occupant room and is not required to be connected in the vicinity of the dash panel 1, must be also connected with the terminals 65, in the connector 50, it is necessary to cut the entire lines of the harness 74 within the engine room, in a side of a power source, in the vicinity of the dash panel 1.

Accordingly, there are problems that the numbers of processes for cutting the harness 74 within the engine room and for connecting with the connector 50 are increased and a great deal of harness material is required, thereby increasing a manufacturing cost.

SUMMARY OF THE INVENTION

The present invention is made in consideration of the problems as described above, it is therefore, an object of the present invention to provide a connector structure capable of minimizing a space for connecting harnesses disposed in first and second spaces in opposite sides of a dash panel.

It is also another object of the present invention to provide a connector structure in which portions for connecting the harnesses are eliminated and a manufacturing cost can be reduced.

To attain the aforementioned objects, a connector structure according to a first aspect of the present invention comprises:

a first connector member having a peripheral edge portion abutted with a peripheral edge of an opening provided in a panel defining a first space and a second space, from the first space; and a second connector member fitted to the first connector member, from the second space and having a peripheral edge portion abutted with the peripheral edge of the opening to hold the peripheral edge of the opening by the peripheral edge portions of the first and second connector members.

A first harness, which is connected with the first connector member, from the first space and a second harness, which is connected with the second connector member, from the second space, are connected electrically.

At least one of the first and second connector members is provided with a communication path configured to communicate the first and second spaces A connector structure according to a second aspect of the present invention comprises:

a first connector member having a peripheral edge portion abutted with a peripheral edge of an opening provided in a panel defining a first space and a second space, from the first space and having a lever inserting hole;

a second connector member fitted to the first connector member, from the second space and having a peripheral edge portion abutted with the peripheral edge of the opening to hold the peripheral edge of the opening by the peripheral edge portions of the first and second connector members and having a lever inserting hole;

a first harness connected with the first connector member, from the first space;

a second harness connected with the second connector member, from the second space and connected electrically with the first harness; and a lever member having an operating portion and a shaft portion extending from the operating portion for being inserted through the lever inserting hole of the first connector member 20 in the lever inserting opening of the second connector member, from the first space.

Furthermore, a mechanism for engaging the first and second connector members is provided between the shaft portion and the lever inserting hole of the second connector member, in response to the rotation of the lever member.

BRIEF DESCRIPTION OF THE DRAWINGS

FIG. 14A to FIG. 14D are pattern diagrams in which FIG. 14A shows a state of inserting a third harness in the first connector member and an opening H, FIG. 14B a state of disposing a cockpit module in position, FIG. 14C a state of fitting temporally the first and second connector members, FIG. 14D a state of the completed connection of the first and second connector members.

DETAILED DESCRIPTION OF THE PREFERRED EMBODIMENTS

Several embodiments of the present invention will be explained with reference to the accompanying drawings below.

Figure 1:
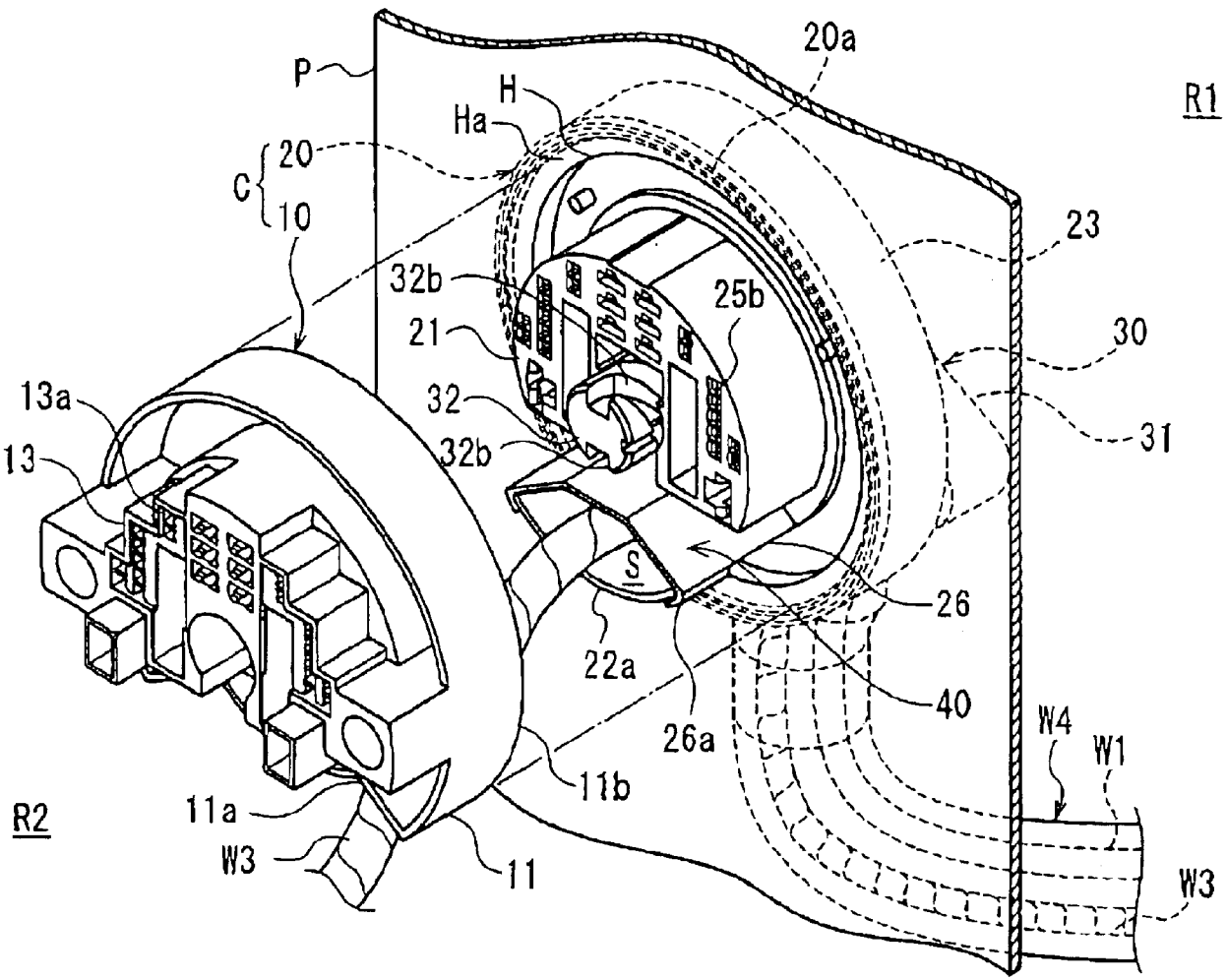
FIG. 1 is a perspective view explaining how to use a connector having a connector structure according to the present invention.

A connector C in one embodiment of the present invention is disposed on a dash panel P as a panel for defining a first space or engine room R1 and a second space or occupant room R2, as shown in FIG. 1. In the embodiment, the engine room R1 is disposed in a front side of a vehicle and the occupant room R2 is disposed in a backside of the vehicle.

The connector C comprises a first connector member 20 having a peripheral edge portion 20*a* abutted, from the engine room R1, with a peripheral edge Ha of an opening H provided in the dash panel P, a second connector member 10 fitted to the first connector member 20 from the occupant room R2 and having a peripheral edge portion 11*b* abutted with the peripheral edge Ha to hold the peripheral edge Ha by the peripheral edge portions 20*a* and 11*b*, and a lever member 30 for pulling the first connector member 20 to fit the first and second connector members 20 and 10.

Figure 8:
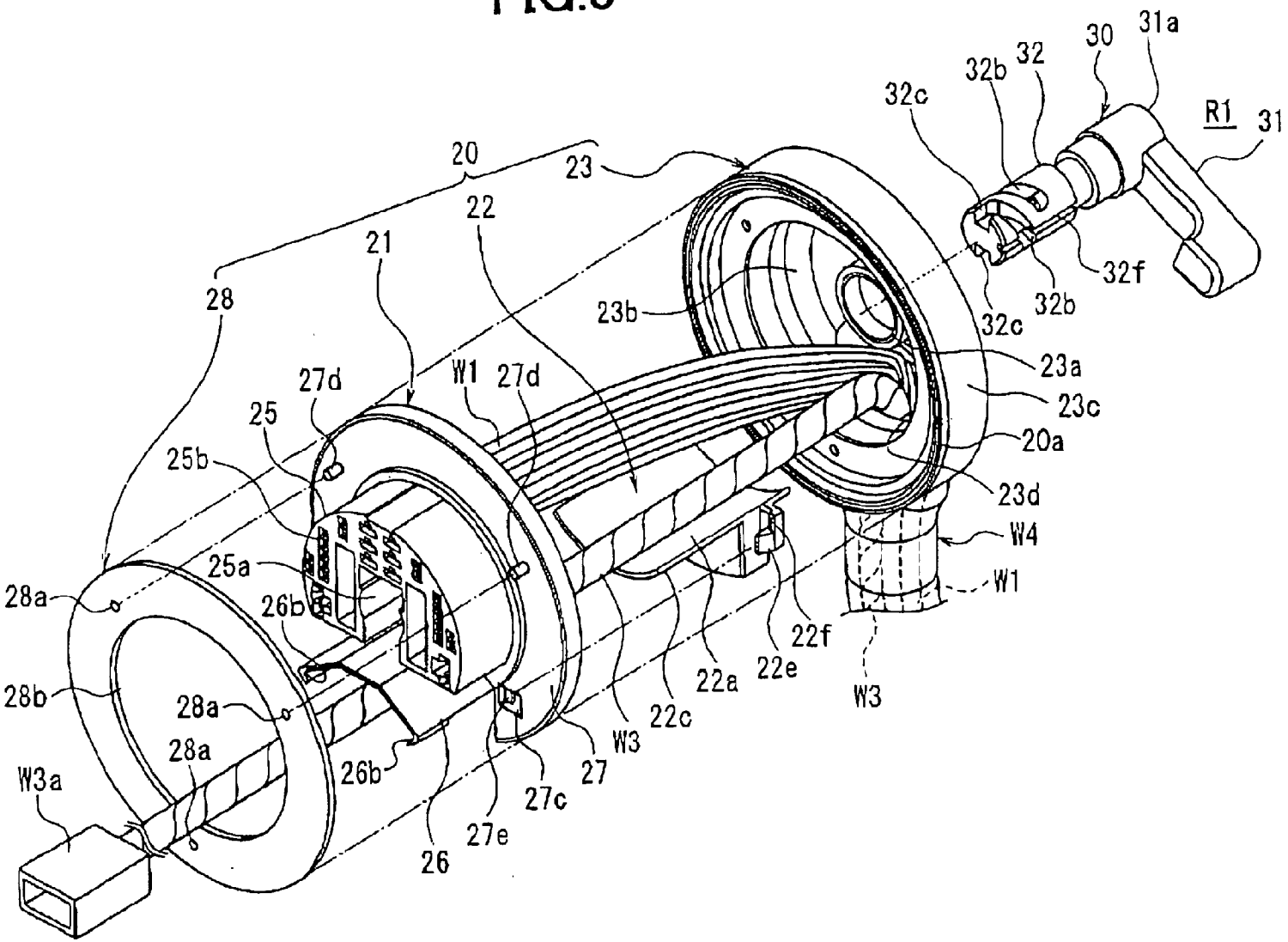
FIG. 8 is a perspective view explaining a method for installation of the first connector member and lever member.

The first connector member 20 includes a first connector body portion 21 having a circular connecting terminal portion 26, a cover member 23 disposed in the engine room R1 and adapted to cover the first connector body portion 21, and a ring-shaped scaling member 28, as shown in FIGS. 1 and 8.

As shown in FIG. 1, a communication path S or communication tube 40 for communicating the engine and occupant rooms is provided in at least one of the first and second connector members 20 and 10. The communication tube 40 is arranged in the first connector member 20 in the embodiment. The communication tube is composed of a plurality of separated parts, for example, an upper section 26 and a lower section 22 configured to be fitted slidably to a lower portion of the upper section 26, as shown in FIG. 8.

Figure 3:
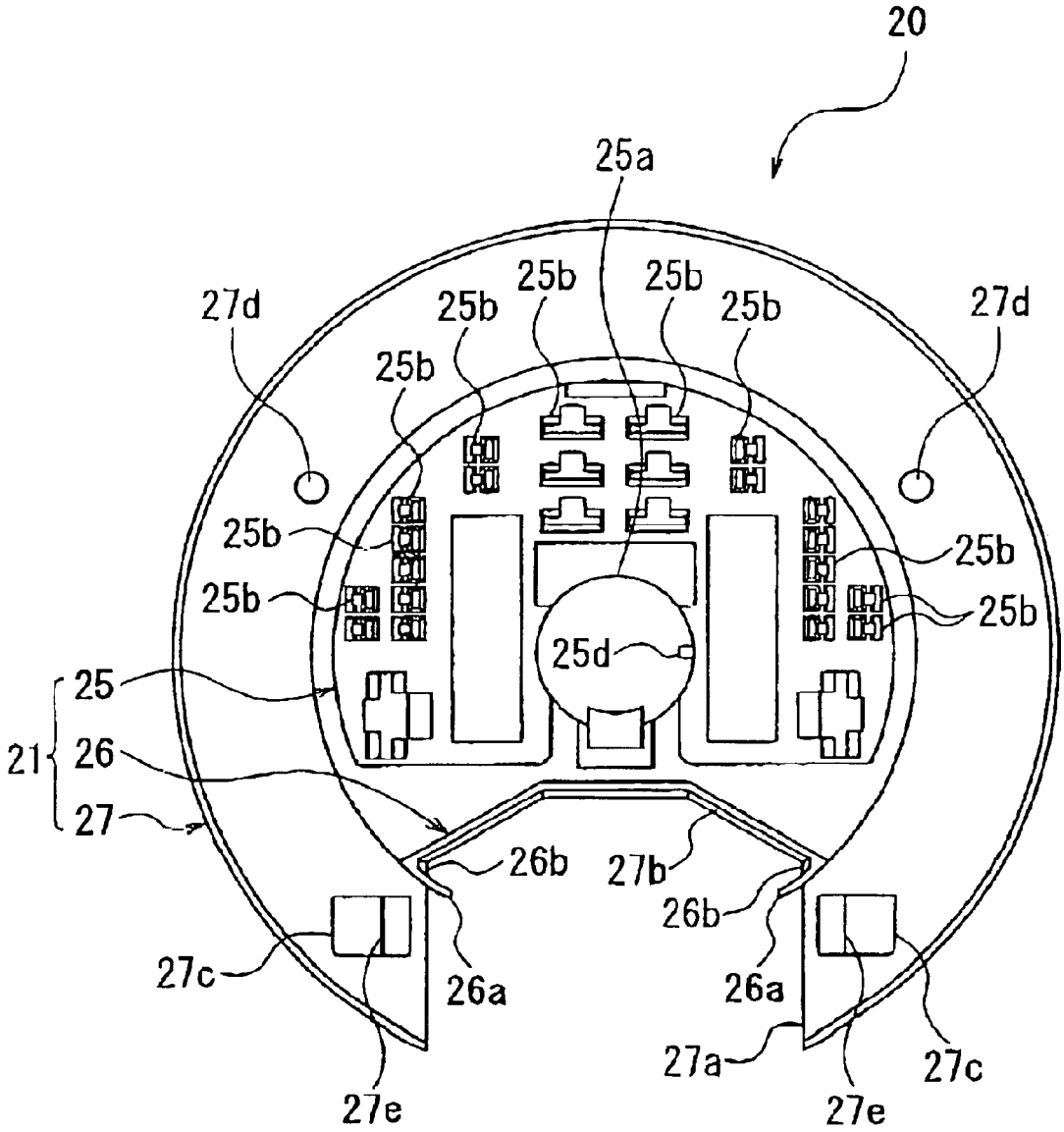
FIG. 3 is a back view showing a first connector member in the connector having the connector structure according to the present invention.
Figure 4:
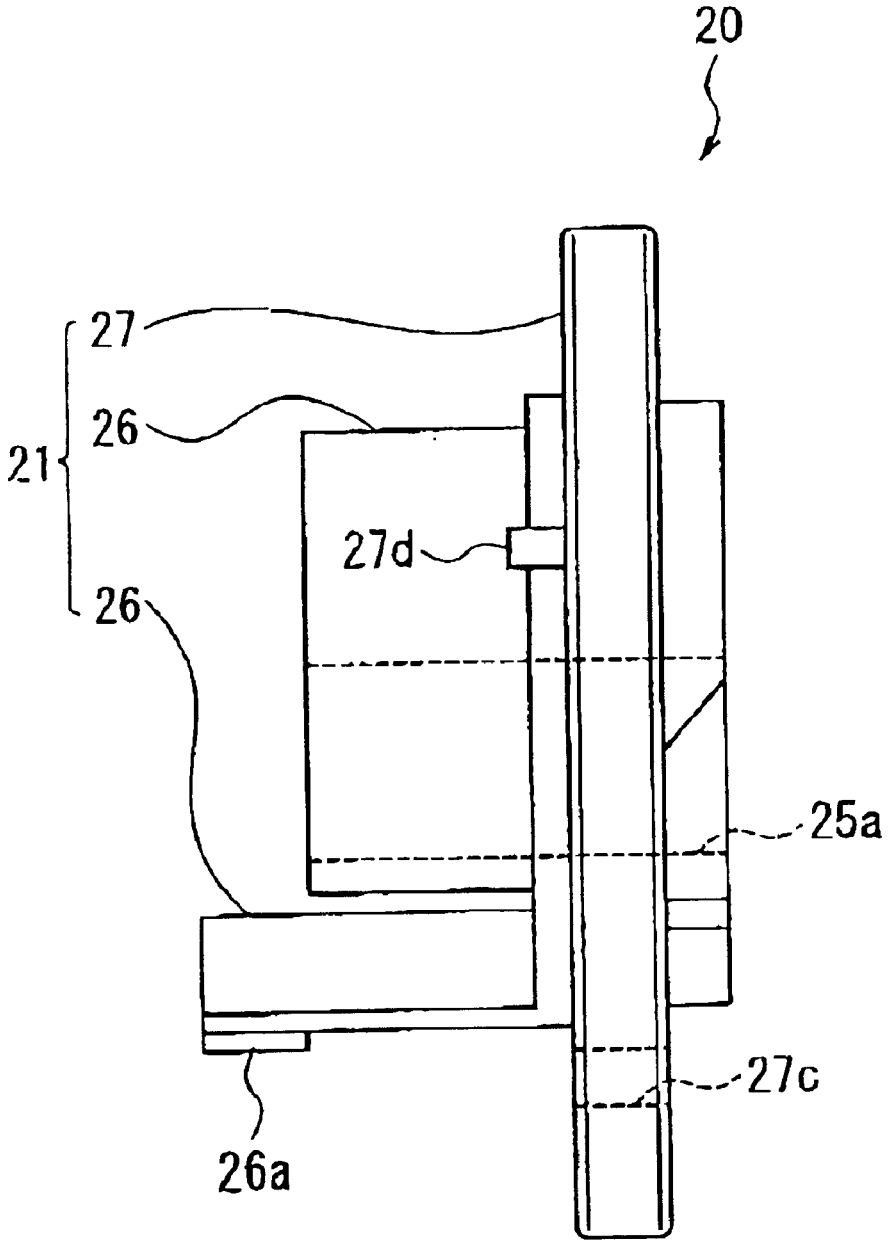
FIG. 4 is a side view showing the first connector member in the connector having the connector structure according to the present invention.

The first connector body portion 21 has a generally circular shape as shown in FIG. 3 and has a flange 27 extending radially from the circular connecting terminal portion 25 and a notch 27*a* provided downwardly of the flange 27.

An upper area 27*b* of the notch 27*a* is formed into a trapezoidal shape.

As shown in FIGS. 1 to 4, the upper section 26 of the communication tube 40 extends into the occupant room R2 from the upper area 27*b*.

The upper section 26 of the communication tube 40 has a generally similar trapezoidal shape as the upper area 27*b* and has an opened lower portion and extends to project into the occupant room R2 (see FIG. 1).

Provided on right and left lower ends of leading end portions of the upper section 26 in the occupant room R2 are L-shaped curved engaging pieces 26*a* and 26*a* to form slide groove 26*b* and 26*b* for inserting the lower section 22 (see FIG. 3). A further explanation of the communication tube will be described hereinafter.

As shown in FIG. 3, the first connector body portion 21 has small holes 27*c* and 27*c* formed in a lower portion of the flange 27 and protrusions 27*d* and 27*d* for engaging a seal member, which are provided near an upper portion of the flange 27 to project toward the occupant room R2.

The small holes 27*c* and 27*c* are arranged near the notch 27*a* and engaging walls 27*e* and 27*e* are formed in the small holes 27*c* and 27*c*.

Figure 5:
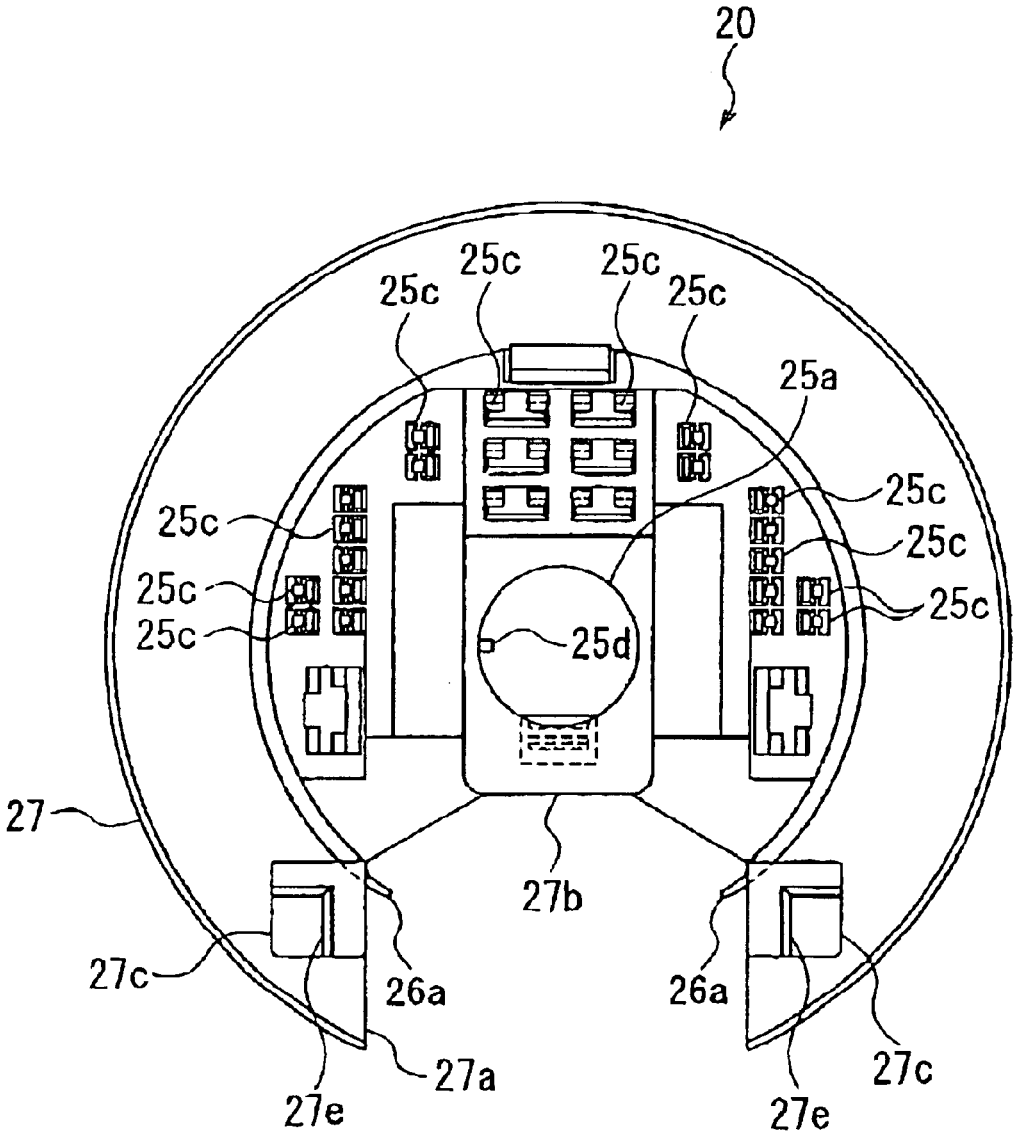
FIG. 5 is a front view showing the first connector member in the connector having the connector structure according to the present invention.

The connecting terminal portion 25 has a lever inserting hole 25*a* as a through hole for inserting the lever member 30 and first terminals 25*b* provided on a side of the occupant room R2 and second terminals 25*c* provided on a side of the engine room R1 as shown in FIG. 5.

The lever inserting hole 25*a* is provided passing through the connecting terminal portion 25 and arranged at a central portion of the connecting terminal portion 25.

Moreover, a small column-shaped key convex portion is provided in the lever inserting hole 25*a* to project inwardly thereof.

In addition, the first and second terminals 25*b* and 25*c* are disposed to surround the lever inserting hole 25*a*.

Moreover, the second terminals 25*c* are connected with a first harness W1 provided in the engine room R1 and configured to conduct through a circuit (not shown) with the first terminals 25*b*.

In addition, in the embodiment, the first harness W1 is conducted electrically with a CPM harness W2 and is disposed in a combined harness W4 together with a third harness W3 having a body connector W3*a* for connecting with a harness for an accelerator and so on, as shown in FIG. 8.

Figure 6:
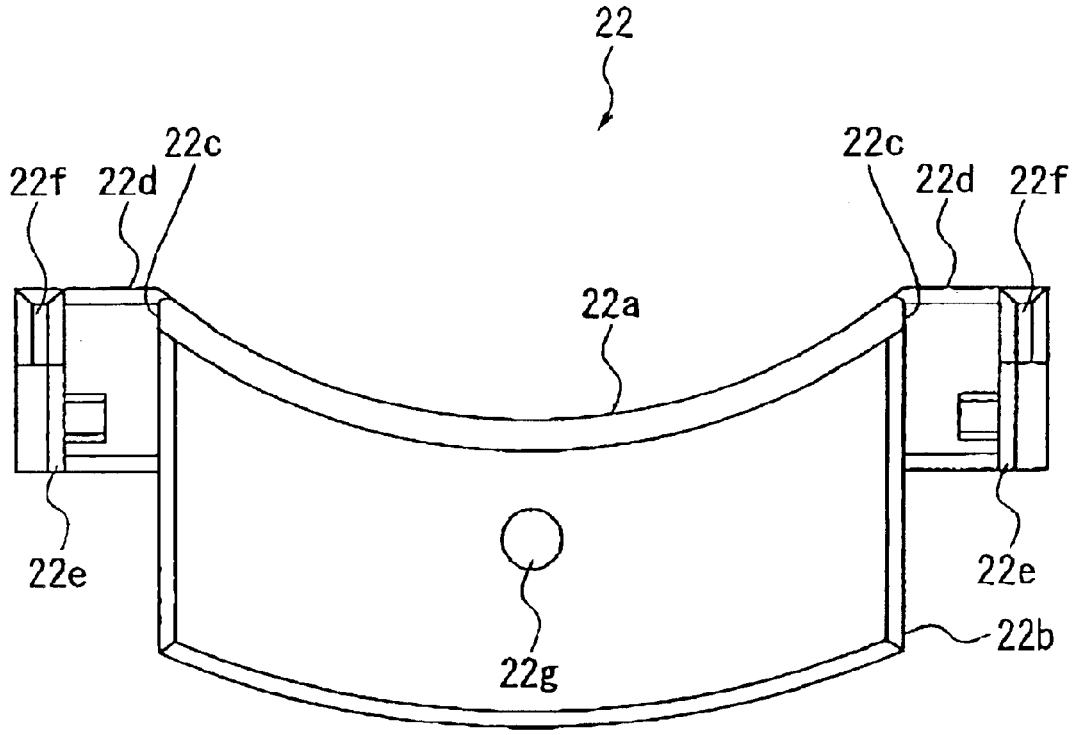
FIG. 6 is a back view showing a lower section in the connector having the connector structure according to the present invention.
Figure 7:
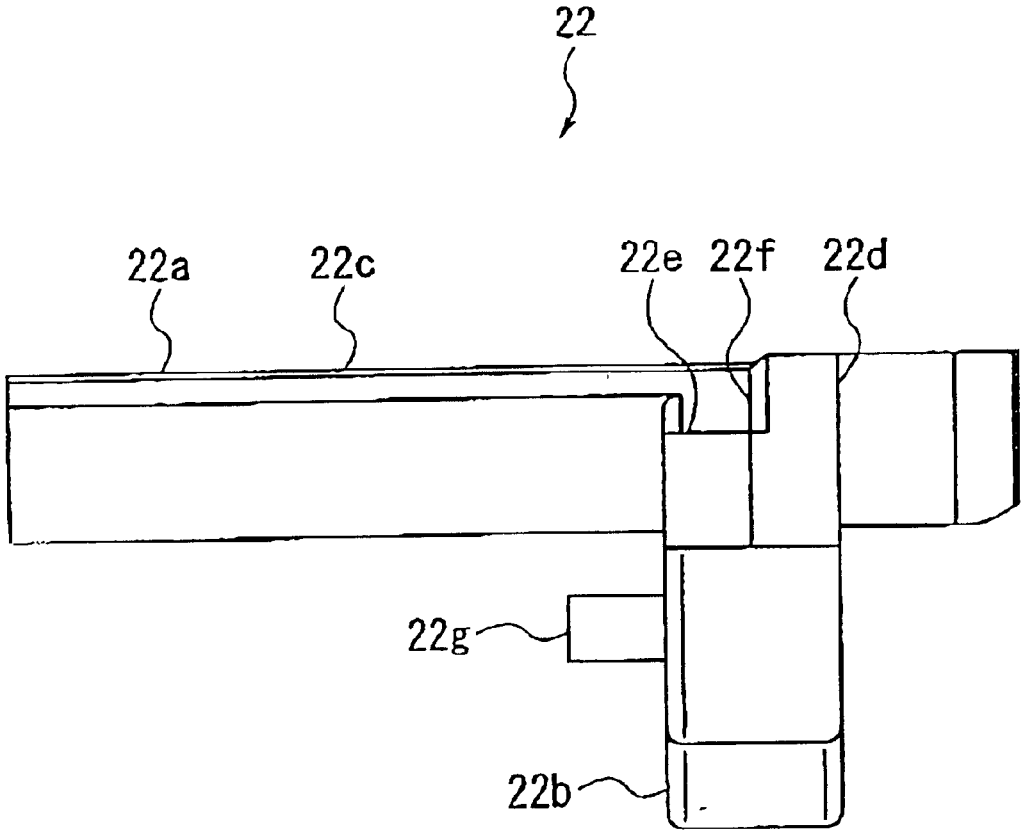
FIG. 7 is a side view showing the lower section in the connector having the connector structure according to the present invention.

The lower section 22 of the communication tube 40 has a body portion 22*a* and a lower flange 22*b* extending downwardly from the body portion 22*a*, as shown in FIGS. 6 and 7.

The body portion 22*a* has an arc shape curved downwardly and a shape extending backwardly.

Moreover, the body portion 22*a* has opposite side ends 22*c* and 22*c* configured to be inserted slidably in the slide grooves 26*b* and 26*b*.

When the lower section 22 is assembled in the first connector body portion 21 by inserting the opposite side ends 22*c* and 22*c* of the body portion 22*a* in the slide grooves 26*b* and 26*b*, a communication path S is formed between the upper and lower sections 26 and 22, as shown in FIG. 1.

An arc lower surface of the lower flange 22*b* has a shape corresponding to a peripheral surface of the flange 27 centering on an axis of the lever inserting hole 25*a* to form a ring shape by the flange 27 and lower flange 22*b*, when the opposite ends 22*c* and 22*c* the body portion 22*a* are inserted in the slide grooves 26*b* and 26*b*.

On a central portion of the lower flange 22*b* is formed a second convex portion 22*g* for engaging the seal member, which is the same shape to that of the convex portion 27*d* (see FIG. 6).

Furthermore, as shown in FIG. 6, on opposite surfaces of the lower flange 22*b* are provided side plates 22*d* and 22*d* which have abutment pieces 22*f* and 22*f* for abutting with the flange 27 in assembling the lower section to the first connector body portion 21.

The side plates 22*d* and 22*d* are provided with resilient engaging pieces 22*e* and 22*e* at positions corresponding to the small holes 27*c* and 27*c*.

In other wards, the resilient engaging pieces 22*e* and 22*e* are disposed at positions inserting them in the small holes 27*c* and 27*c* in assembling the lower section 22 to the first connector body 21, as shown in FIG. 8.

When the resilient engaging pieces 22*e* and 22*e* are inserted in the small holes 27*c* and 27*c* and the abutment pieces 22*f* and 22*f* are abutted with the flange 27, the resilient engaging pieces 22*e* and 22*e* are engaged with the engaging walls 27*e* and 27*e* to be prevented the lower section 22 from removing out of the upper section 26.

The cover member 23 has an opened back surface of bottomed cylindrical shape, which is located in the occupant room R2, as shown in FIG. 8, and includes a central circular bottom portion 23*b* having a lever inserting hole 23*a*, a cylindrical portion 23*c* extending toward the occupant room R2 from a peripheral edge of the circular bottom portion 23*b*, and an opening 23*d* provided on a lower end of the cylindrical portion 23*c* for inserting the third harness W3.

The first connector member 20 is formed by installation of the first connector body portion 21 within the cover member 23, and a peripheral edge of the cover member 23 is adapted to configure a peripheral edge 20*a* of the first connector member 20.

The seal member 28 has a ring shape generally similar to that of the flange 27 and is made of an elastic material such as a rubber.

The seal member 28 has also fitting holes 28*a*, and a central opening 28*b* and the seal member 28 is assembled by fitting the convex portions 27*d* for engaging the seal member and the convex portion 22*g* for engaging the second seal member, in the fitting holes 28*a*.

Figure 2:
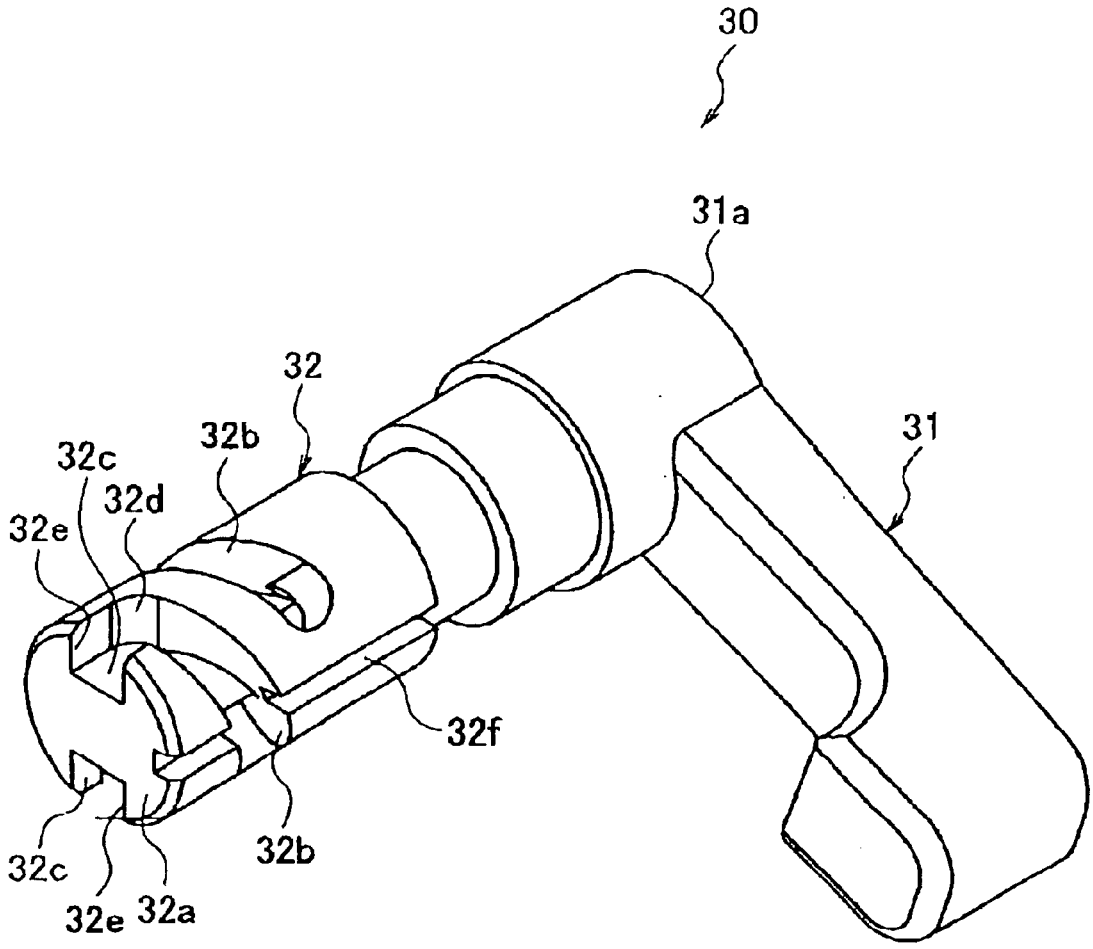
FIG. 2 is a perspective view showing a lever member in the connector having the connector structure according to the present invention.

As shown in FIG. 2, the lever member 30 has a rectangular operating portion 31 disposed in the first space or engine room R1 and a shaft portion 32 which is inserted through the lever inserting hole 25*a* of the first connector member 20 from the first space R1 in a lever inserting opening 10*a* provided in the second connector member 10.

The shaft portion 32 is bent perpendicularly from a basic portion 31*a* of the operating portion 31 and has a leading end 32*a*, as shown in FIG. 2. The shaft portion 32 has also a cylindrical shape.

It should be noted that a mechanism for engaging the first and second connectors 20 and 10 in response to the rotation of the lever member 30 is provided between the shaft portion 32 and the lever inserting hole 10*a* of the second connector member 20. In one embodiment, the engaging mechanism has two helical grooves 32*b* and 32*b* as cam grooves, which are provided on an outer peripheral surface of the shaft portion 32.

The two helical grooves 32*b* and 32*b* are positioned on the opposite sides with respect to each other across an axis of the shaft portion 32 and formed spirally, Moreover, the helical grooves 32*b* and 32*b* has at the leading end 32*a* introducing openings 32*c* and 32*c* for forming openings 32*e* and 32*e*.

Each of the introducing openings 32*c* and 32*c* is formed by extending to curve from a corner 32*d* disposed in the vicinity of the leading end 32*a* to the leading end 32*a*.

The shaft portion 32 has also a key groove 32*f* extending linearly from leading end 32*a* to the basic portion 31*a*.

The key groove 32*f* is set in a size such a manner that a key protrusion 25*d* provided within the lever inserting hole 25*a* of the first connector member 20 is engaged slidably in the key groove 32*f*.

As shown in FIGS. 9 to 12, the second connector member 10 includes a cylindrical body 11 having at a lower area thereof a notch 11*a*, a front terminal portion 12 disposed in the engine room R1 (forward side), and a back terminal portion 13 disposed in the occupant room R2 (backward side). In addition, the lever inserting opening 10*a* as described above is provided at a central portion of the cylindrical body 11 so as to pass through the cylindrical body from the forward side to the backward side.

Figure 10:
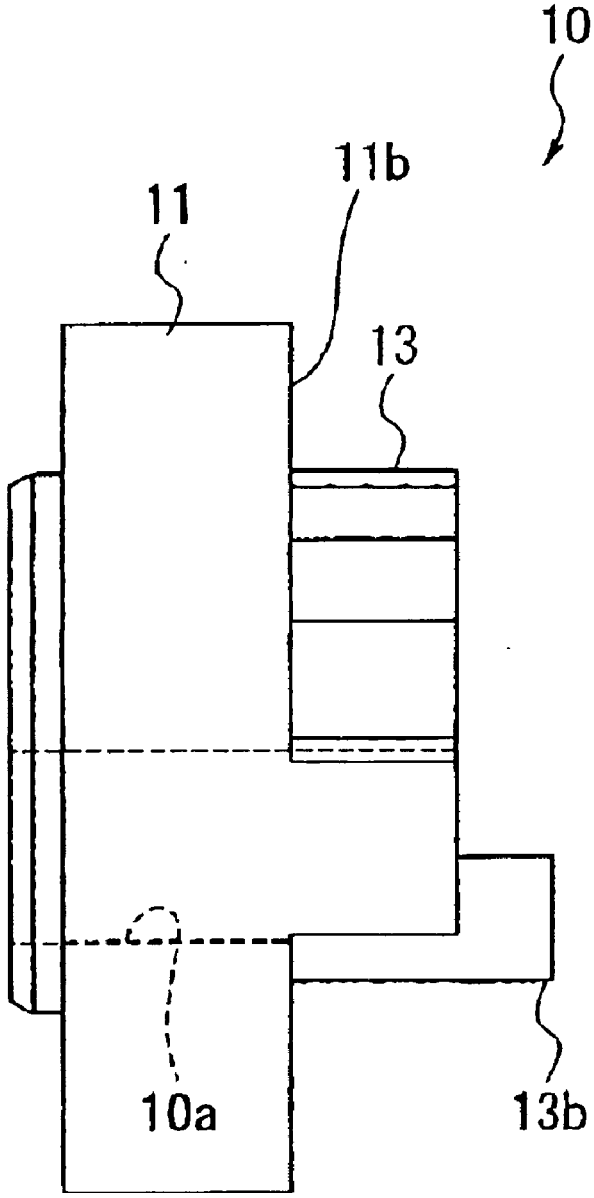
FIG. 10 is a side view showing the second connector member in the connector having the connector structure according to the present invention.
Figure 12:
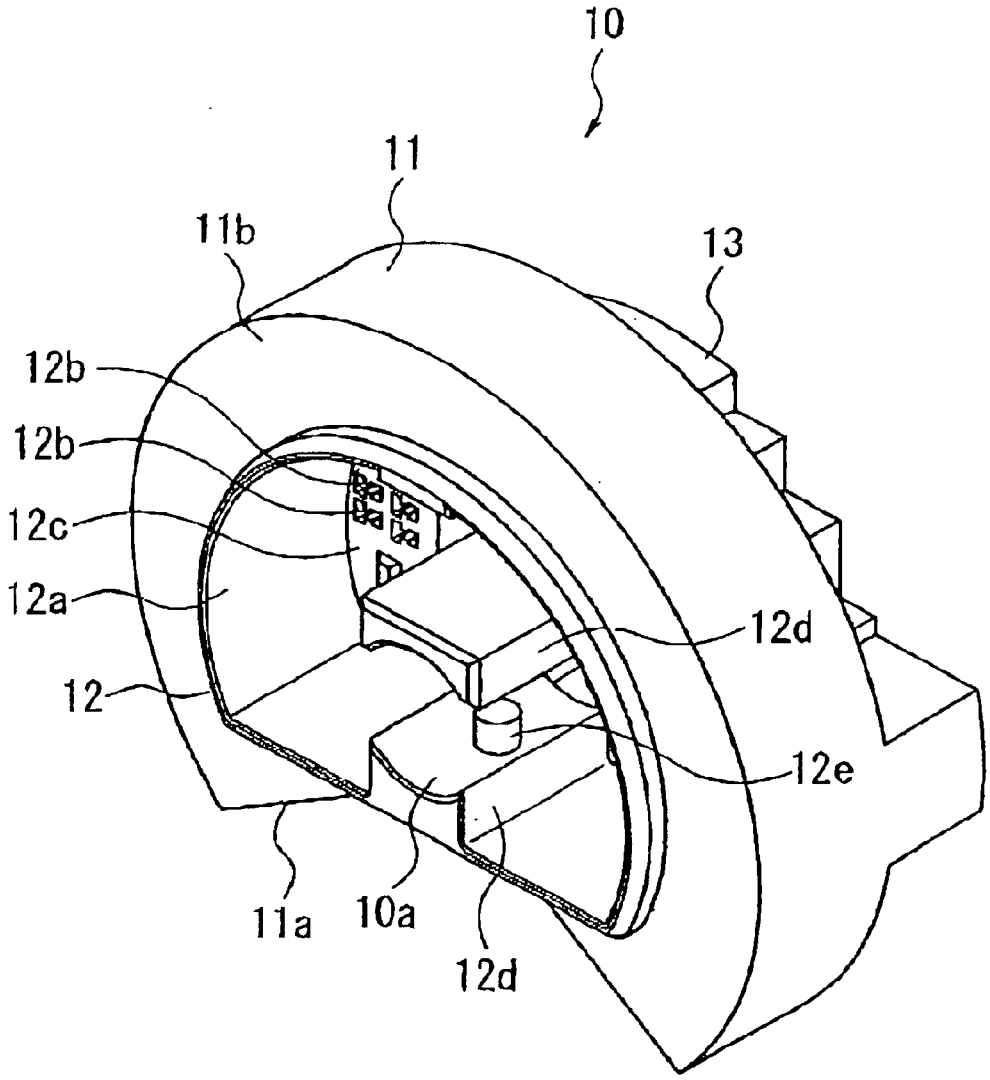
FIG. 12 is a perspective view showing the second connector member in the connector having the connector structure according to the present invention.

The size of the cylindrical body 11 is set in such a manner that a front surface 11*b* of the forward side of the cylindrical body 11 is adapted to contact with the peripheral edge Ha of the opening H of the dash panel P, and the front surface 11*b* forms a peripheral edge portion of the second connector member 10 (see FIGS. 1, 10 and 12).

The notch 11*a* of the cylindrical body 11 is formed in a trapezoidal shape similar to the upper section 26 so that the upper section can be fitted to the notch 11*a*.

Figure 11:
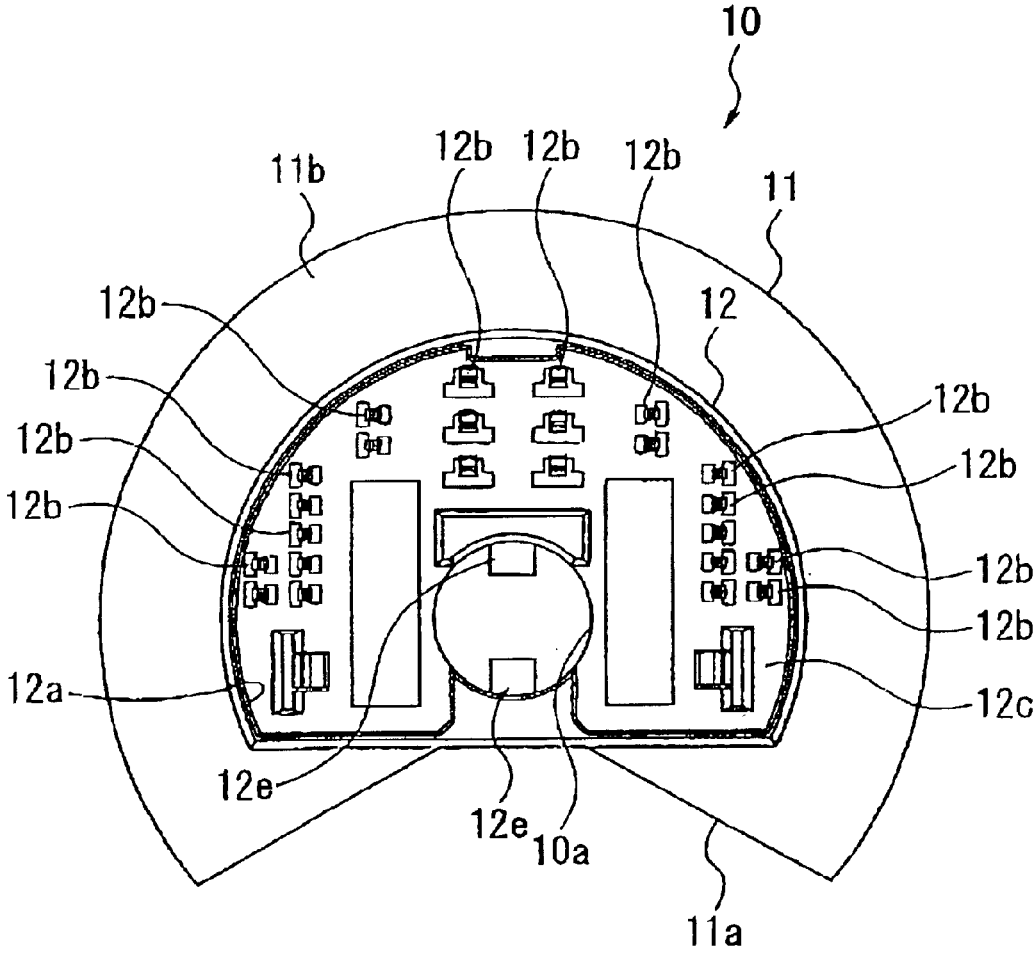
FIG. 11 is a front view showing the second connector member in the connector having the connector structure according to the present invention.

As shown in FIGS. 11 and 12, the front terminal 12 includes a frame portion 12*a* recessed backwardly, in other words, toward the engine room R1, and third terminals 12*b* provided on a frame bottom surface 12*c* of the frame portion 12*a*.

The frame portion 12*a* is formed into a generally half cylindrical shape so as to be capable of fitting to the terminal portion 25 of the first connector member 20.

Moreover, through opening forming portions 12*d* and 12*d* are projected from the frame bottom surface 12*c* to the front side.

The opposite surfaces of the through opening forming portions 12*d* and 12*d* are formed into a circular arc to form the lever inserting opening 10*a* between the through opening forming portions 12*d* and 12*d*.

The through opening forming portions 12*d* and 12*d* are provided with cam follower portions 12*e* and 12*e* which are adapted to engage slidably in the helical grooves 32*b* and 32*b* provided in the lever member 30 to form the aforementioned engaging means.

The cam follower portions 12*e* and 12*e* are arranged in a position inserted through the openings 32*e* and 32*e* in the introducing openings portions 32*c* and 32*c*, when the shaft portion 32 is passed through the lever inserting hole 25*a* by engagement of the key protrusion 25*d* in the key groove 32*f* in a state (temporally inserted state) that the first connector body portion 21 is inserted until an intermediate position in the cylindrical body 11 of the second connector member 10.

A back terminal portion 13 is provided on the cylindrical body 11 to project therefrom, as shown in FIG. 10.

Figure 9:
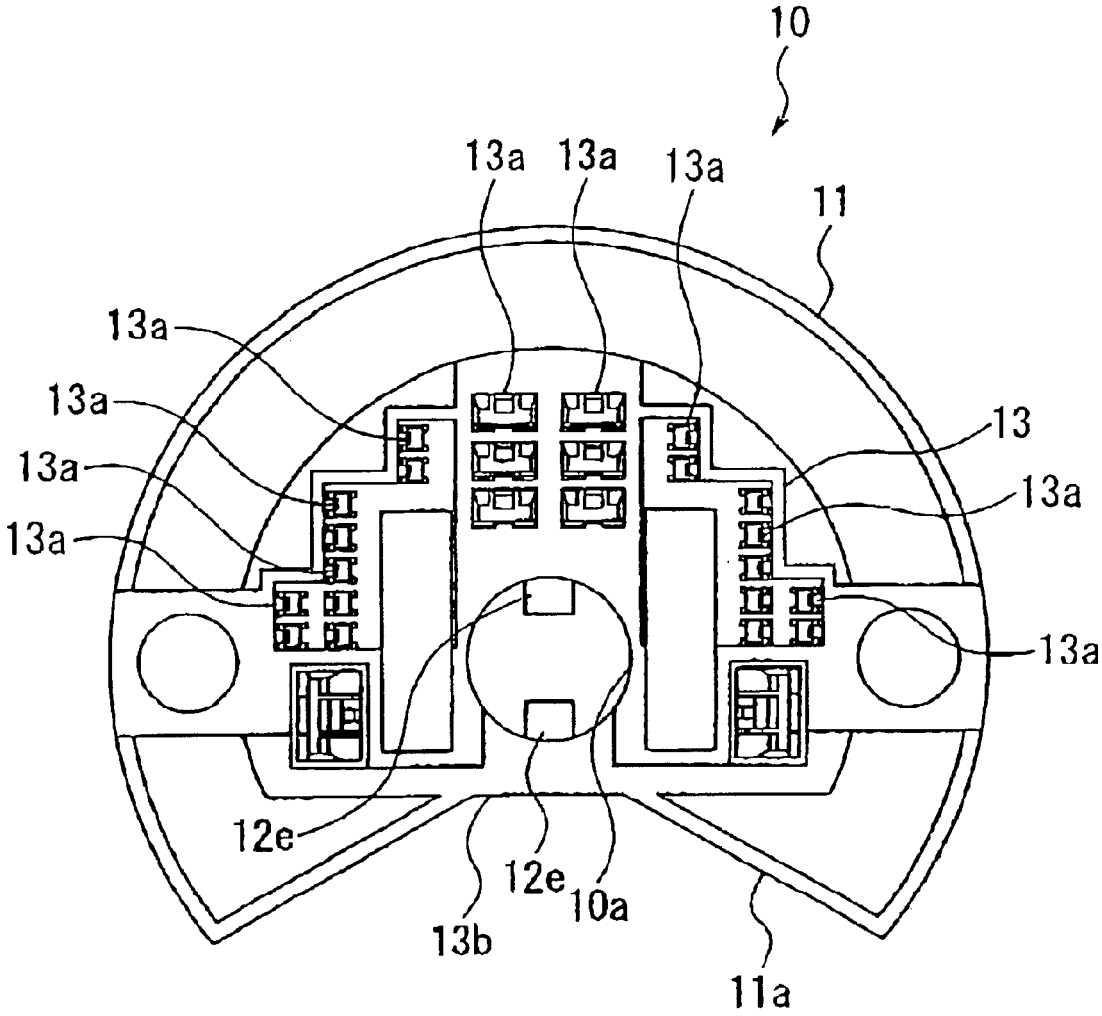
FIG. 9 is a back view showing a second connector member in the connector having the connector structure according to the present invention.

The back terminal portion 13 has fourth terminals 13*a*, as shown in FIG. 9. In the embodiment, a CPM harness W2 as a second harness can be connected with the back terminal portion 13, as shown in FIG. 14.

The CPM harness W2 corresponds to a harness from a cockpit module M disposed in the vicinity of the dash panel P in the occupant room R2 and is connected electrically with the first harness W1.

Subsequently, an operation of the connector C having the structure as described above will be explained based on a method for wiring harnesses.

First, in the engine room R1, the combined harness W4 is connected with the cover member 23, as shown in FIG. 8.

More specifically, the first and third harnesses W1 and W3 are inserted in the opening 23*d* for harnesses, then the first harness W1 is connected with the second terminals 25*c* of the first connector body portion 21 and the third harness W3 is disposed in the position at the communication path S of the first connector body portion 21, namely, in a lower position of the upper section 26.

In this located state, the ends 22*c* and 22*c* of the lower section 22 are inserted slidably in the slide grooves 26*b* of the upper section 26 from the engine room R1 and then the lower section 22 is assembled to the first connector body portion 21 to form the communication path S or communication tube 40.

In this way, in the connector C, because the communication path S is formed by the first connector body portion 21 or the upper and lower section 26 and the lower section 22 or the two separated parts, even if the opening area of the communication path S is less, if the two parts are assembled to form the communication path S, after the harness is disposed at the communication path S in a disengaged state of the two parts, the harness may be in a state of inserting easily in the formed communication path S.

Figure 14A:
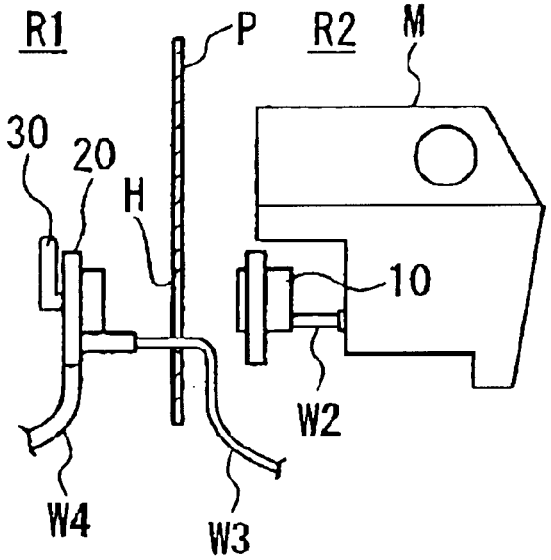

Next, the third harness W3 is inserted in the central opening 28*b* of the seal member 28, and further in the opening H as shown in FIG. 14(A) and then is wired within the occupant room R2.

Subsequently, the convex portions 27*d* and 22*g* are inserted in the fitting holes 28*a* and then the seal member 28 is attached on the back surface of the flange 27.

In the state as described, the cover member 23 is mounted on the first connector body portion 21 so as to house the first connector body portion 21 from the engine room R1.

Moreover, as shown in FIG. 8, the shaft portion 32 is inserted in the lever inserting holes 23*a* and 25*a* and the key protrusion 25*d* is inserted in the key groove 32*f*.

In this way, if the shaft portion 32 is inserted in the lever inserting holes 23*a* and 25*a* by inserting the key protrusion 25*d* in the key groove 32*f*, the shaft portion 32 can be inserted in the lever inserting hole 25*a* while maintaining a predetermined proper angle within the lever inserting hole.

On the other hand, the CPM harness W2 of the cockpit module M is connected with the fourth terminals 13*a* of the second member 10.

Figure 14B:
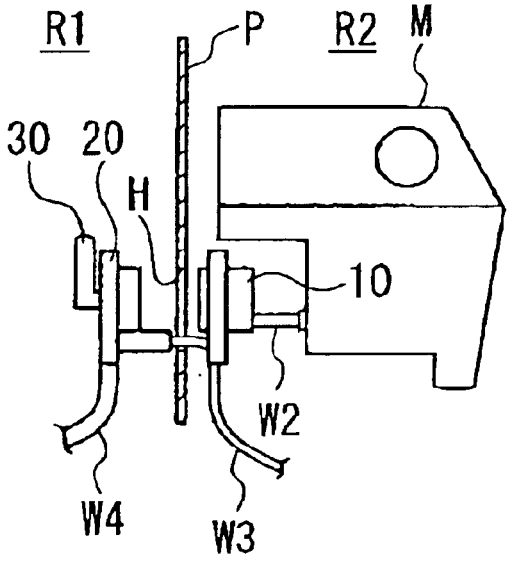

In this way, the cockpit module M, in which the second connector member 10 is attached to the leading end of the CPM harness W2, is disposed in position within the occupant room R2, as shown in FIG. 14(B).

When the cockpit module M is disposed in position, the second connector member 10 at the leading end of the CPM harness W2 is disposed adjacent the dash panel P.

Figure 14C:
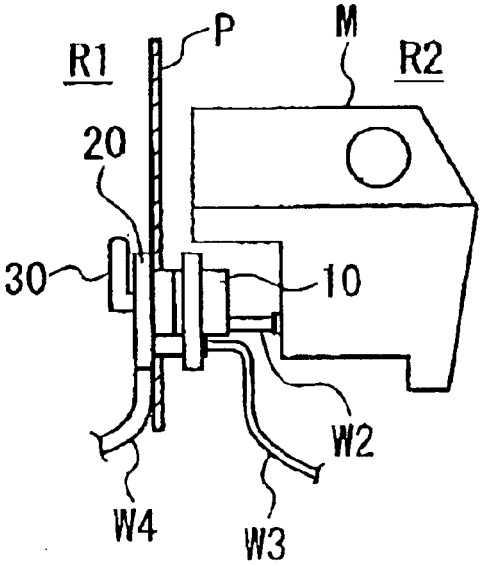

At this time, the second connector member 10 is positioned to face the opening H and then the first connector member 20 is temporally fitted through the opening H to the second connector member 10, as shown in FIG. 14(C).

In other words, until the peripheral edge portion 20*a* of the first connector member 20 is abutted with the peripheral edge Ha of the opening H, the first connector body portion 21 is inserted in the opening H from the engine room R1 and then the first connector body portion 21 is inserted until an intermediate position in the cylindrical body 11 of the second connector member 10 while sliding the notch 11*a* on the upper section 26.

Moreover, in the temporal combined state, if the shaft portion 32 of the lever member 30 is further driven toward the occupant room R2, the cam follower portions 12*e* and

12*e* are inserted through the openings 32*e* and 32*e* in the introducing opening portions 32*c* and 32*c*, thereby abutting with the corners 32*d*.

As a result, because the shaft portion 32 has the key protrusion 25*d* engaging in the key groove 32*f* in the connector C, it is possible to insert the shaft portion 32 in the lever inserting hole 25*a* with maintaining of the predetermined angle and to introduce easily the cam follower portions 12*e* and 12*e* in the introducing opening portions 32*c* and 32*c*.

Figure 13:
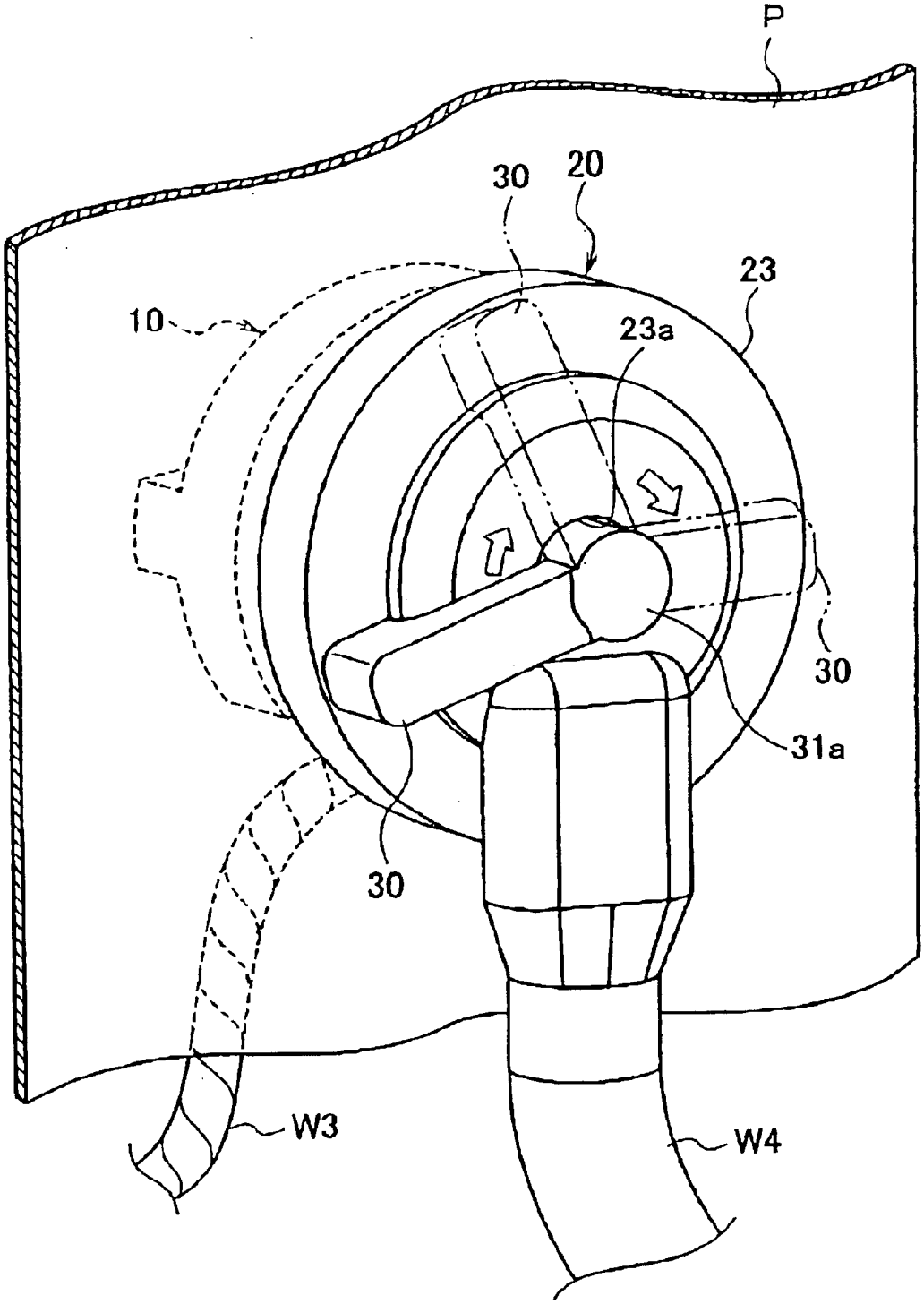
FIG. 13 is a perspective view explaining a method for fitting the first and second connector members.

Next, in such a state the first connector member 20 is Attached temporally to the second connector member 10, the cam follower portions 12*e* and 12*e* are inserted in the introducing opening portions 32*c* and 32*c*, the lever member 30 is rotated about the axis of the shaft portion 32 by gripping the operating portion 31, as shown in FIG. 13.

When the lever member 30 is rotated, the cam follower portions 12*e* and 12*e* of the second connector member 10 are moved along the helical grooved 32*b* and 32*b* of the shaft portion 32, and therefore the second connector member 10 can be moved toward the engine room R1 in proportion to the rotational angle of the shaft portion 32.

Consequently, the first connector body portion 21 and cylindrical body 11 are combined and first terminals 25*b* and third terminals 12*b* are electrically connected to conduct electrically the first harness W1 and CPM harness W2.

In this way, in the connector C, only by rotating the operating portion 31 of the lever member 30 from the state of temporal assembling, the first and second connector members 20 and 10 can be fitted.

Figure 14D:
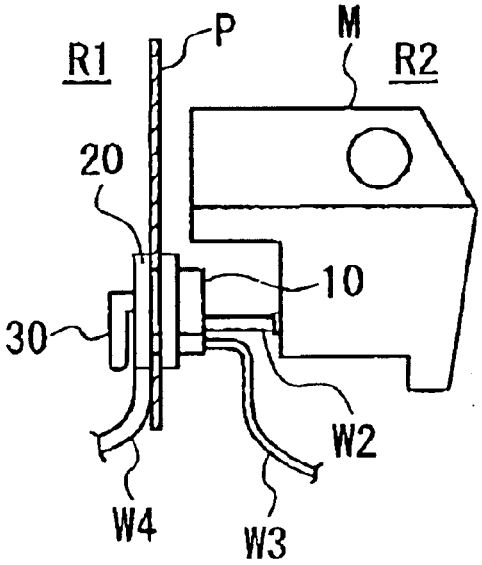
Figure 15:
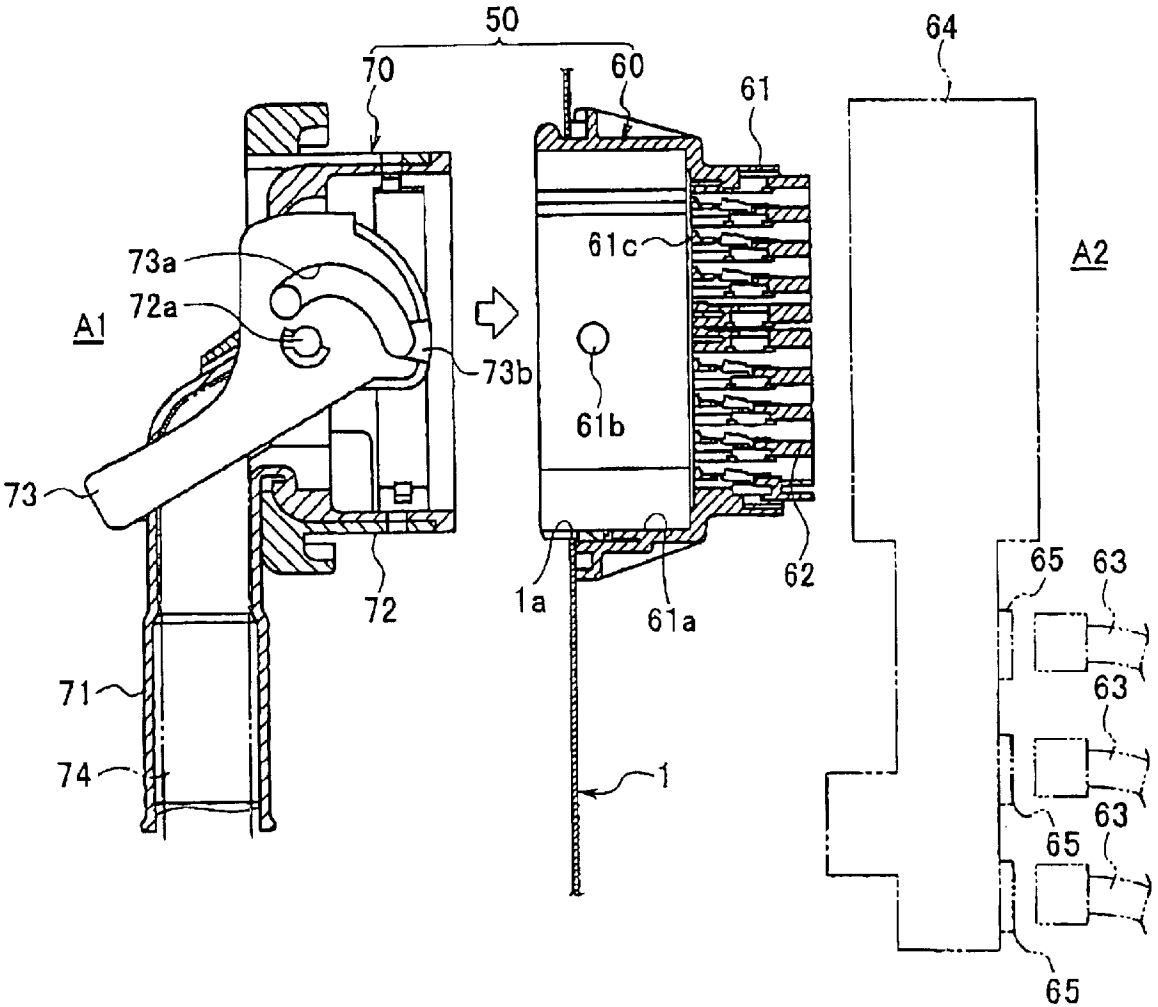
FIG. 15 is a sectional view showing a state before fitting a connector disposed in an occupant room and a connector disposed in an engine room, in a conventional connector.
Figure 16:
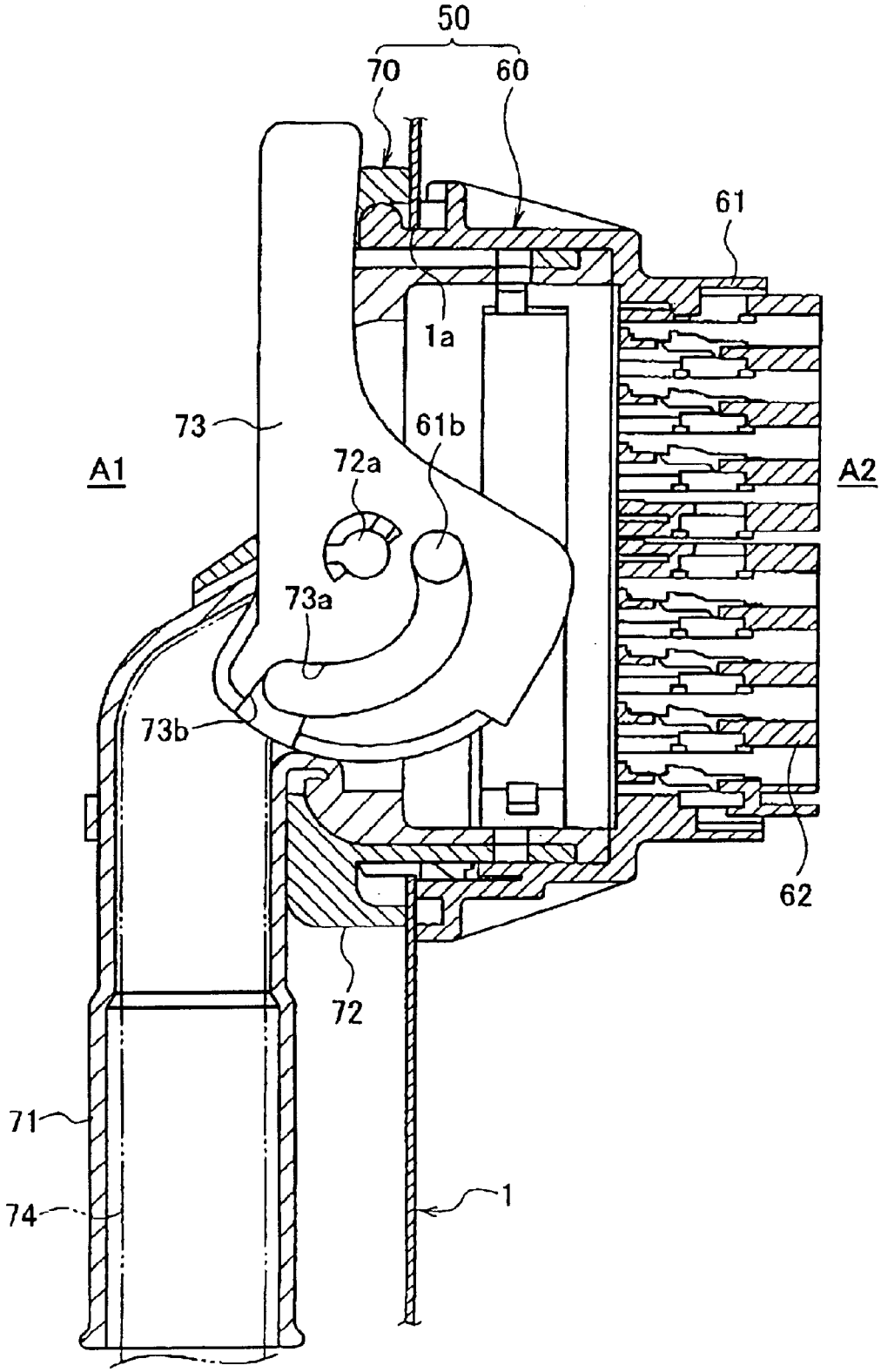
FIG. 16 is a sectional view showing a state after fitting the connector disposed in the occupant room and the connector disposed in the engine room, in the conventional connector.

As the operating portion 31 is further rotated, the seal member 28 is held between the first second connector members 20 and 10, as shown in FIG. 14D and the peripheral edge Ha of the opening H is held between their peripheral edge portions 11*b* and 20*a* of the second and first connector members 10 and 20, to thus complete the assemble of the second and first connector members 10 and 20.

In this way, a result, when the second connector member 20 is fitted to the first connector member 10, the operating portion 31 is rotated along the dash panel P in the connector C and therefore the operating portion 31 is not moved away from the dash panel P.

As a result, the connector C makes it possible to be less a space throughout the forward and backward directions of the vehicle, necessary to fit the second connector member 10 to the first connector member 20.

According to the wiring method for the harnesses using the connector C, a working space for connecting the connector members is unnecessary in the occupant room R2, it is therefore possible to intend an effective utilization for a space of the occupant room R2.

Moreover, when assembling the second and first connector members 20 and 10 as described above, the communication path S for communicating the engine and occupant rooms R1 and R2 is formed, and the third harness W3 parsing through the communicating path S can be wired throughout the engine and occupant rooms R1 and R2.

In other words, because the communication path S for communicating the engine and occupant rooms R1 and R2 is provided in the connector C for electrically conducting the first and CPM harnesses W1 and W2, in the embodiment, the third harness WS can be wired throughout the engine and occupant rooms R1 and R2, by it passing through the communication path S.

Accordingly, there is no need to connect the third harness W3 with the connector C, it is therefore possible to eliminate working steps, because it is sufficient to connect only the first and CPM harnesses W1 and W2 necessary for connection with the connector C.

Furthermore, because the communicating path S is provided in the first connector member 20, the third harness W can be wired throughout the engine and occupant R1 and R2 through the connector C disposed in the opening H, without providing the other opening in the dash panel P.

Therefore, the work for providing the opening is not required and a seal such as a grommet member provided in the other opening for waterproofing is also required.

In the connector C, the seal member 28 is held between the first and second connector members 20 and 10 only by rotating the operating portion 31 to hold water-tightness.

As a result, according to the connector C it is possible to maintain easily the water-tightness.

Moreover, in the connector C, because the shaft portion 32 is inserted in the central portion of the ring-shaped seal member 28, when the second connector member 10 is fitted to the first connector member 20, a pressed force can be imparted approximately uniformly to the whole of the seal member 28.

Consequently, it is possible to catty out the increment of water-tightness of the seal member 28 in the connector C.

Moreover, in the connector C, the first terminals 25*b* are arranged to surround the lever inserting hole 25*a* and the third terminals 12*b* are arranged to surround the lever inserting hole 10*a*.

Therefore, the first and third terminals 25*b* and 12*b*, which conduct electrically the first and second connector members 20 and 10 are positioned to surround the shaft portion 32.

Accordingly, when the second connector member 10 is fitted to the first connector member 20, a pressed force can be imparted approximately uniformly to the whole of the first and third terminals 25*b* and 12*b*, to carry out more firmly the connection of the first and third terminals 25*b* and 12*b*.

Furthermore, in the above connector C, if the operating portion 31 is rotated, the peripheral edge Ha is held by means of the first and second connector members 20 and 10, so that the connector C is fixed on the peripheral edge Ha.

Consequently, it is possible to fix the connector C on the panel P easily, without requiring the other working such as the mounting it by a screw.

Moreover, in the connector C, the first connector member 20 can be fitted to the second connector member 10 only by rotating the operating portion 31 of the lever member 30 along the cover member 23, with a less space in the forward and backward directions of the vehicle, thereby, accomplishing an effective utilization of space in the vehicle.

Further, according to the connector C, the working space for connecting the first and second connector members 20 and 10 is not required in the occupant room R2, it is therefore possible to accomplish an effective utilization of space in the occupant room R2.

Furthermore, because the operating portion 31 of the lever member 30 is perpendicular to the shaft portion and is disposed to extend along the panel, the operating portion is not moved away from the panel if the operating portion is rotated centering on the shaft portion.

Although the present invention has been described with respect to the several embodiments referring to the accompanying drawings, the present invention is not limited to these embodiments, various changes and modifications can be made to the embodiments within the scope of the present invention.

For example, in the embodiments, the helical grooves are provided in the shaft portion as the cam portions, and the cam follower portions formed into the convex portions are engaged in the helical grooves, but the grooves and cam follower portions may be formed into spiral shapes for engaging with each other, while only the cam follower portions may be formed into a spiral shape.

In other words, at least one of the cam and cam follower portions may be formed in a spiral shape capable of moving the second connector member toward the first connector member when the lever member is rotated.

With the configuration as described above, the second connector member can be moved toward the first connector member by engaging the cam and cam follower portions and only by rotating the lever member to be capable of fitting the second connector member to the first connector member.

What is claimed is:

1. A connector structure comprising:

a first connector member having a peripheral edge portion abutted with a peripheral edge of an opening provided in a panel defining a first space and a second space, from said first space;

a second connector member fitted to said first connector member, from said second space and having a peripheral edge portion abutted with said peripheral edge of said opening to hold said peripheral edge of the opening by said peripheral edge portions of said first and second connector members;

a first harness connected with said first connector member, from the first space; and a second harness connected with said second connector member, from said second space and connected electrically with said first harness, wherein at least one of said first and second connector members includes a communication path configured to communicate said first and second spaces.

2. The connector structure according to claim 1, wherein said communication path is formed by a plurality of separated parts.

3. A connector structure comprising:

a first connector member having a peripheral edge portion abutted with a peripheral edge of an opening provided in a panel defining a first space and a second space, from said first space and having a lever inserting hole;

a second connector member fitted to said first connector member, from said second space and having a peripheral edge portion abutted with said peripheral edge of said opening to hold said peripheral edge of the opening by said peripheral edge portions of said first and second connector members and having a lever inserting hole;

a first harness connected with said first connector member, from the first space;

a second harness connected with said second connector member, from said second space and connected electrically with said first harness;

a lever member having an operating portion and a shaft portion extending from the operating portion for being inserted through the lever inserting hole of the first connector member in the lever inserting opening of the second connector member, from the first space; and a mechanism provided between said shaft portion and the lever inserting hole of the second connector member for engaging said first and second connector members in response to the rotation of the lever member;

wherein at least one of said first and second connector members includes a communication path configured to communicate said first and second spaces.

4. The connector structure according to claim 3, wherein said mechanism includes at least one cam portion provided in the shaft portion and a cam follower portion provided in the lever inserting hole for engaging with the cam portion, wherein at least one of the cam and cam follower portions is formed in a helical shape to move the second connector member toward the first connector member when the lever member is rotated.

5. The connector structure according to claim 3, wherein said first connector member includes a ring-shaped seal member having a central portion and said shaft portion is inserted in the central portion of the seal member.

6. The connector structure according to claim 3, further comprising terminal portions to electrically conduct the first and second connector members, wherein said terminal portions are arranged to surround the shaft portion.

* * * * *